US005528620A

United States Patent [19]

Fujita et al.

[11] Patent Number: 5,528,620

[45] Date of Patent: Jun. 18, 1996

[54] LEVITATING AND MELTING APPARATUS AND METHOD OF OPERATING THE SAME

[75] Inventors: Michiru Fujita; Tatsuo Take; Tadashi Morita; Makoto Yoshida, all of Kawasaki, Japan

[73] Assignee: Fuji Electric Co., Ltd., Kanagawa, Japan

[21] Appl. No.: 318,176

[22] Filed: Oct. 5, 1994

[30] Foreign Application Priority Data

Oct. 6, 1993 [JP] Japan ..... 5-249614

[51] Int. Cl.[6] ..... H05B 6/30

[52] U.S. Cl. ..... 373/139; 373/156; 219/648

[58] Field of Search ..... 373/138, 139, 373/144, 145, 146, 147, 148, 156, 158; 219/635, 647, 648, 650; 164/60, 80, 136; 75/10, 65

[56] References Cited

U.S. PATENT DOCUMENTS

| | | | |
|---|---|---|---|
| 3,702,368 | 11/1972 | Hukin | 373/156 |
| 3,775,091 | 11/1973 | Clites et al. | 75/65 |
| 3,841,384 | 10/1974 | Tingquist et al. | 164/60 |
| 4,578,552 | 3/1986 | Mortimer | 219/648 |

FOREIGN PATENT DOCUMENTS

| | | |
|---|---|---|
| 0275228 | 7/1988 | European Pat. Off. . |
| 0428727 | 5/1991 | European Pat. Off. . |
| 0461306 | 12/1991 | European Pat. Off. . |
| 0549984 | 7/1993 | European Pat. Off. . |
| 0576845 | 1/1994 | European Pat. Off. . |
| 3819153 | 11/1981 | Germany . |
| 3819154 | 6/1988 | Germany . |
| 4022561 | 2/1992 | Germany . |
| 4307317 | 2/1994 | Germany . |
| 4-123844 | 4/1992 | Japan . |
| 1697283 | 12/1991 | U.S.S.R. . |
| WO80/00046 | 1/1980 | WIPO . |

*Primary Examiner*—Tu Hoang

*Attorney, Agent, or Firm*—Finnegan, Henderson, Farabow, Garrett & Dunner

[57] ABSTRACT

In addition to a first driving device which moves only a lower crucible, and a first control device which controls the first driving device, a second driving device which changes the vertical relative position of an upper crucible and an induction coil, and a second control device which controls the second driving device are disposed, whereby the relative positions of the upper and lower crucibles and the induction coil can freely be changed. Consequently, the relative positions of the induction coil and the upper and lower crucibles can adequately be set in whole of the operation period from the initial operation stage to the final operation stage, in accordance with the position of a melting zone in the top portion of a material to be melted which grows as a result of continuously charging chips.

5 Claims, 8 Drawing Sheets

LEVITATING AND MELTING APPARATUS AND METHOD OF OPERATING THE SAME

BACKGROUND OF THE INVENTION

1. Field of the Invention

This invention relates to a levitating and melting apparatus in which a conductive material to be melted is placed in an alternating magnetic field to be subjected to induction heating by causing electromagnetic induction therein, and the magnetic field is distributed in a predetermined manner to exert buoyancy due to an electromagnetic force on the material to be melted so that the material to be melted is melted under a levitating state, thereby obtaining a high purity material. The invention relates also to a method of operating the levitating and melting apparatus.

2. Description of the Related Art

A levitating and melting apparatus is an apparatus in which a material to be melted is placed in an alternating magnetic field produced in a predetermined distribution, and both induction heating and buoyancy due to an electromagnetic force are simultaneously exerted on the material so that the material is melted under a state where the material floats to be prevented from making contact with other articles such as a crucible, whereby a product of a given quality and dimensions can be obtained. The apparatus has features such as that the material does not make contact with another article in a melting process and therefore the material is hardly contaminated by foreign substances, that even a material of a high melting point can be melted, and that the loss of heat conduction is small. Because of these features, such an apparatus is used in a process of melting a material which has a high melting point and is requested to have a high purity, such as titanium, or silicon.

FIG. 8 is a perspective longitudinal sectional view showing the whole of a levitating and melting apparatus which is in an operation state, and FIG. 9 is a perspective longitudinal sectional view showing main portions of FIG. 8 in an initial operation state. These figures are shown in U.S. patent application Ser. No. 08/067,149. In the figures, the levitating and melting apparatus comprises: a crucible 1 consisting of an upper crucible 11 and a lower crucible 12; an induction coil 2 wound on the outer face of the crucible 1; a continuous charging device 3 which continuously charges chips 53 to be used as a conductive material to be melted 5 through an upper opening of the crucible 1; a control device 31 which controls the continuous charging device; a molten metal thermometer 32 for obtaining control information for the control device; a first driving device 4 which vertically moves the lower crucible 12; a first control device 41 which controls the first driving device; and a molten metal level gauge 42 for obtaining control information for the first control device. The driving device 4 and control device 41 are identified by providing the term "first" because another driving device and control device are used in the invention and these devices are required to be distinguished from each other.

The induction coil 2 consists of induction coils 21 and 22 respectively connected to AC power sources 23 and 24 for energizing the respective coils. The continuous charging device 3 has an induction coil 33 which is energized by an AC power source 34 to previously heat the chips 53. The configuration in which the induction coil 2 divided into two coils are respectively energized by the different AC power sources 23 and 24 is employed in the case where the functions are allotted among the two coils, namely, the execution of induction heating is mainly allotted to the upper induction coil 21 and the generation of flotation to the lower induction coil 22, so that the functions are efficiently executed. In the case, generally, the induction coil 22 is energized by a frequency lower than that for the induction coil 21. In the invention, however, it is not required to distinguish the two induction coils 21 and 22 from each other. Therefore, these induction coils are collectively dealt as the induction coil 2 in the following description.

As shown in the figures, the upper and lower crucibles 11 and 12 are configured in such a manner that plural segments 111 and 121 each having a predetermined shape are arranged with interposing an insulating material such as mica between them. The crucible 1 which is a combination of the upper and lower crucibles is formed into a substantially cylindrical shape having a bottom. Each of the segments 111 and 121 is made of copper and provided with cooling holes so as to be cooled by cooling water.

FIG. 8 shows a state which is near the final stage of the melting process, and FIG. 9 shows an initial state wherein a small material to be melted 5 floats on a molten metal. In other words, FIG. 8 shows a state wherein the material to be melted 5 grows as a result of processes which will be described in detail, to increase its length. Next, processes in which the material to be melted 5 is actually melted and a predetermined product is obtained will be described.

(1) As shown in FIG. 9, initially, a small amount of the material to be melted 5 is charged and the induction coil 2 is energized. This produces an alternating magnetic field in the space surrounded by the induction coil 2, and eddy currents are induced by electromagnetic induction to flow in the segments 111 and 121 and the material to be melted 5. The magnetic fluxes are distributed so as to be along the inner face of the crucible 1. Since the segments 121 of the lower crucible 12 are shaped so that the lower portion of the inner space of the lower crucible 12 is narrowed as illustrated, the magnetic flux distribution in the vicinity of the bottom where the material to be melted 5 exists has a shape which expands upward. When such eddy currents flow, the material to be melted 5 is heated. On the other hand, interaction between the eddy currents and the above-mentioned magnetic flux distribution generates an electromagnetic force which acts on the material to be melted 5 in the direction opposite to the gravity or in the upward direction. The detailed description of the generation of the force is omitted. As shown in the figures, the shape of the bottom of the lower crucible 12 is set so as to obtain a magnetic flux distribution suitable for generating the flotation.

(2) The electromagnetic force starts to be exerted on the material to be melted 5 at the same time as the energization of the induction coil 2, and the material to be melted 5 starts in a short time delay to float and stops at a position where the electromagnetic force balances with the gravity. The material to be melted 5 has a high melting point and requires a considerably long period to be melted. When the temperature of the material to be melted reaches the melting point, therefore, the material to be melted has already entered the levitating state. Consequently, the material to be melted 5 is prevented from making contact with another articles, and hence free from contamination with impurities.

(3) The chips 53 of the material to be melted 5 are charged by the continuous charging device 3. The chips 53 are previously heated by the electromagnetic induction heating due to the induction coil 33, to a high temperature which is lower than the melting point. The charged chips 53 then make contact with the material to be melted 5 and are heated by means of heat conduction to a temperature higher than the melting pint, resulting in that the chips is melted to be literally united with the material to be melted 5 into one body. As the continuous charge of the chips 53 proceeds, the material to be melted grows to increase the dimensions. The charging frequency is adequately controlled in such a manner that the charging of the chips 53 is conducted when the molten metal thermometer 32 indicates a temperature higher than a given value and is not conducted when the thermometer indicates a temperature lower than the given value.

(4) Since the degree of increase in flotation of the material to be melted 5 is smaller than that in weight of the material to be melted, the levitating position is gradually lowered as the material to be melted 5 grows, and the lower portion of the material to be melted 5 finally makes contact with the bottom of the lower crucible 12. Since the lower crucible 12 is cooled as described above to be maintained at a low temperature in the vicinity of ordinary temperature, the portion in contact with the lower crucible is immediately solidified. In this way, a solidified portion 52 is first formed, and then grows as the material to be melted 5 grows. A melting zone 51 always exists on the top portion of the material to be melted 5, and the chips 53 are dropped into the melting zone 51. Since the melting zone 51 is on the solidified portion 52, the melting zone is prevented from making contact with the crucible 1. Consequently, the material to be melted 5 can grow to a large extent under conditions that the material to be melted is free from contamination with impurities.

(5) When the growth of the material to be melted 5 proceeds to some extent, the lower crucible 12 is controlled to be moved downward so that the melting zone 51 is maintained at a predetermined position with respect to the upper crucible 11 and the induction coil 2. In this control, the position of the upper face of the material to be melted 5 is measured by means of the molten metal level gauge 42, the measuring result is supplied to the first control device 41, and the lower crucible 12 is moved by the first driving device 4 on the basis of the measuring result.

(6) When the length of the material to be melted 5 reaches a given value, the operations of moving the lower crucible 12, charging the chips 53, and energizing the induction coil 2 are stopped. Since the whole of the material to be melted 5 which has grown into a cylindrical shape as shown in FIG. 8 is solidified, the solidified material is then removed as a desired product from the crucible. The dimensions, particularly the length, of the product depend on the moving distance of the lower crucible 12. Consequently, the levitating and melting apparatus has a feature that a product which is far longer as compared with the capacity of the crucible 1 can be obtained.

In FIG. 8, the gap between the solidified portion 52 of the material to be melted 5 and the inner face of the crucible 1 is illustrated so as to have a fairly large size. As seen from the above description, however, the fact is that the gap between the solidified portion 52 and the inner face of the crucible 1 is substantially zero or has a very small size. In the figure, the melting zone 51 is illustrated so as to have an irregular face. This intends to show actual phenomena such as deformation caused by vibration of the melting zone 51 at the instant the chips 53 enter the melting zone 51. When the effect of the charging of the chips 53 is not exerted, the actual shape of the melting zone 51 is maintained to be a stable axially symmetrical shape as described later.

A very large current of several thousands amperes flows through the induction coil 2, and the frequency of the current is very high or as high as several kilohertz. Therefore, conductors and lead wires of the induction coil must have a large sectional area so that it is difficult to vertically move the induction coil 2. Although connected to pipes for cooling water, in contrast, the upper and lower crucibles 11 and 12 can be moved more easily by far than the induction coil 2. Also in an actual apparatus, consequently, it is configured so that the induction coil 2 is fixed and the lower crucible 2 is movable.

The position at which the upper crucible 11 is made contact with the lower crucible 12 in FIG. 9 must adequately be set. As described above, the induction coil 2 must allow a very large current to pass through, and realize a large ampere turn in order to produce a magnetic field of a given strength. Therefore, the dimension of the coil in the axial direction is requested to be as large as possible. When the height of the induction coil 2 is constant, the upper and lower crucibles of the crucible 1 make contact with each other at a position which is higher than the lower face of the induction coil 2, with the result that the lower portion of the induction coil 2 downward projects from the upper crucible 11. Under this state, as shown in FIG. 8, the downward movement of the lower crucible 12 causes a portion of the solidified portion 52 not to be in contact with the inner face of the crucible 1, and there may arise a phenomenon that a portion near the upper crucible 11 is again melted by magnetic fluxes entering from the outside and then solidified. This produces a problem in that the growth of the material to be melted 5 is obstructed. Furthermore, another problem is produced in that the portion of the induction coil 2 projecting from the upper crucible 11 is exposed to radiation heat of the hot material to be melted and the temperature of the portion is raised, whereby the deterioration of the insulating material is accelerated to shorten the life period. In order to prevent these problems from arising, the induction coil 2 must be located in such a manner that its lower face is set to be higher than the lower face of the upper crucible 11. This means that the plane in which the upper and lower crucibles 11 and 12 makes contact with each other must be located at a lower position. Under the state where the material to be melted 5 floats as shown in FIG. 9, the plane in which the upper and lower crucibles 11 and 12 makes contact with each other is located in the vicinity of the levitating material to be melted 5. As a result, magnetic fluxes entering through the plane in which the upper and lower crucibles 11 and 12 makes contact with each other affect the material to be melted 5 so that the portion of the material to be melted 5 in the vicinity of the plane is depressed by an electromagnetic force, thereby producing a problem in that the material to be melted 5 has an unstable shape or, for example, the material to be melted is deformed into a guitar-like shape. In fact, it is difficult in some cases to adequately set a positional relationship between the lower crucible 12 and the induction coil 2 in which all the above-discussed problems are prevented from arising.

In the case where the material to be melted 5 is titanium or zirconium as described above, when melted in the air, these materials are contaminated with impurities or an oxide film is formed, because they have a particularly high activity, thereby producing a problem in that the purity is lowered. When such a material is to be melted, therefore, employed is a system in which a levitating and melting apparatus is placed in a vacuum vessel and the melting process is conducted in a vacuum. As described above, in order to intensively cool the crucible 1 and the induction coil 2, the levitating and melting apparatus must be connected with the outside through the pipes for cooling water, the lead wires for supplying a current to the induction coil 2, etc. These connections must be conducted with passing through the vacuum vessel, thereby producing a further problem in that the configuration is complex and the cost of the apparatus is high.

SUMMARY OF THE INVENTION

It is an object of the invention to provide a levitating and melting apparatus which can stably be operated in whole of the operating period and manufacture products of high quality at a low cost, and also a method of operating the levitating and melting apparatus.

In order to solve these problems, according to the invention, a levitating and melting apparatus comprises: a crucible in which a plurality of segments made of a good-conductive metal and having a predetermined sectional shape are compactly arranged through an insulating material, the crucible being divided in a predetermined horizontal plane into upper and lower crucibles; an induction coil which is disposed in an outer face side of the crucible; an AC power source which supplies a current to the induction coil; a continuous charging device which continuously charges chips of a conductive material to be melted through an upper portion of the crucible; a first driving device which changes a vertical relative position of the upper and lower crucibles; and a first control device which controls the first driving device, wherein the apparatus further comprises: a second driving device which changes a vertical relative positions of the upper crucible and the induction coil; and a second control device which controls the second driving device. An inner face of the upper crucible may be formed into a conical shape which expands downward at a predetermined angle. The apparatus may further comprise an upper-crucible rotating device which rotates the upper crucible, and the upper crucible may be rotated at least during a period when the material to be melted grows and makes contact with an inner face of the upper crucible. At least one notched portion may be formed on an inner face of an upper portion of the lower crucible.

The apparatus may further comprise: an upper gas inlet device which covers the upper portion of the upper crucible, and which has a gas pipe through which an inert gas is flown into the inside of the upper crucible; and a horizontal gas inlet device comprising: a hollow tubular portion which is disposed between and concentrical with the crucible and the induction coil, and which has a gas outlet hole on an inner face; and a gas pipe through which an inert gas is flown into the inside of the hollow tubular portion.

The apparatus may further comprise: a molten level gauge which measures a plurality of vertical positions of the vicinity of a top of a melting zone; curvature calculation means for receiving a signal output from the molten level gauge, and for calculating a curvature of the top of the melting zone; and control means for controlling the second control device so as to maintain the relative position of the induction coil and the upper crucible, on the basis a signal output from the curvature calculation means, the control means conducting a control so as to make the curvature of the top of the melting zone coincident with a predetermined value.

These apparatuses are operated in the following sequence:

a) introducing a small amount of the material to be melted into the crucible, and energizing the induction coil under a state where the upper and lower crucibles are close to each other and the induction coil is disposed in an outer face side of the lower crucible;

b) continuously charging chips of the conductive material to be melted through the upper portion of the crucible;

c) relatively moving a position of the induction coil as the material to be melted grows to increase the height in accordance with the charging of chips, to maintain the induction coil located at an adequate position with respect to a position of a melting zone of a top portion of the material to be melted;

d) when the melting zone grows to reach an upper limit in the upper crucible, fixing a relative position of the upper crucible and the induction coil, and downward moving only the lower crucible, to keep the upper crucible and the induction coil located at adequate positions with respect to the position of the melting zone;

e) when the lower crucible is moved by a predetermined distance, stopping the movement of the lower crucible, and stopping the energization of the induction coil; and f) removing the cylindrical material to be melted as a product from the crucible.

According to the configuration of the invention, in addition to the first driving device which moves only the lower crucible, and the first control device which controls the first driving device, the second driving device which changes the vertical relative position of the upper crucible and the induction coil, and the second control device which controls the second driving device are disposed, so that the relative positions of the upper and lower crucibles and the induction coil can freely be changed. Consequently, the relative positions of the induction coil and the upper and lower crucibles can adequately be set in whole of the operating period from the initial operation stage to the final operation stage, in accordance with the position of the melting zone in the top portion of the material to be melted which grows as a result of continuously charging chips.

In the configuration wherein the inner face of the upper crucible is formed into a conical shape which expands downward at a predetermined angle, the lower end portion of the surface area of the melting zone which makes contact with the inner face of the upper crucible and is then solidified has a diameter that is smaller than the inner diameter of a portion of the upper crucible which position is lower than the solidified portion. Accordingly, a gap is formed between the solidified portion and the upper crucible so that the friction resistance generated when the solidified portion is lowered together with the lower crucible is reduced to a very small level.

In the configuration wherein an upper-crucible rotating device which rotates the upper crucible is disposed and the upper crucible is rotated during a period when the material to be melted grows and makes contact with the inner face of the upper crucible, the contacting portion where the upper crucible makes contact with the solidified portion is always shifted, and hence the friction resistance to the vertical movement appears as a kinetic friction resistance. As compared with the case where the upper crucible is not rotated and the friction resistance is caused by a static friction, therefore, the downward movement of the material to be melted together with the lower crucible is conducted more smoothly.

In the above-mentioned configuration wherein the upper crucible is provided with the rotating device, at least one notched portion may be formed on the inner face of an upper portion of the lower crucible. When the melting zone pass over the notched portion in the process of growing the material to be melted, the solidified portion enters the notched portion so that the resistance to the rotation is increased to a very large value. Even when cracks are formed between the respective segments of the upper crucible and the molten material is inserted into the cracks and the friction resistance to the torque between the upper crucible and the material to be melted is increased, therefore, the material to be melted is prevented from rotating with respect to the lower crucible or sliding over it.

Alternatively, an upper gas inlet device which covers the upper portion of the upper crucible and has a gas pipe through which an inert gas flows into the inside of the upper crucible, and a horizontal gas inlet device comprising: a hollow tubular portion which is disposed between and concentrical with the crucible and the induction coil and which has a gas outlet hole on an inner face; and a gas pipe through which an inert gas is flown into the inside of the hollow tubular portion may be disposed. When an inert gas is introduced from the outside through the gas inlet devices during the melting process, the surface of the material to be melted is covered by the inert gas.

In the configuration wherein a plurality of vertical positions of the vicinity of the top of the melting zone are measured by the molten level gauge, an output signal obtained as a result of the measurement is supplied to the curvature calculation means to calculate the curvature of the top of the melting zone, and the relative position in the vertical direction between the induction coil and the upper crucible is controlled so that the output signal is coincident with a predetermined value, the melting zone is maintained to have an optimum shape so that conditions for obtaining the maximum efficiency is maintained.

When such a levitating and melting apparatus is operated in the following sequence, the effects described below are produced.

a) Under a state where the upper and lower crucibles are close to each other and the induction coil is disposed in the outer face side of the lower crucible, a small amount of the material to be melted is introduced into the crucible and the induction coil is energized. This causes the material to be melted to be subjected to an induction heating and the temperature of the material is raised. Also, an upward electromagnetic force in accordance with the magnetic flux distribution in the crucible acts on the material to be melted so that the material floats against the gravity to suspend at a fixed position. Since the induction coil is in the outer face side of the lower crucible in which the material to be melted is contained, the induction heating and the application of flotation are conducted efficiently.

b) Chips of the material to be melted are continuously charged through the upper portion of the crucible. The chips enters the material to be melted in a molten state and is then heated to melt to be united with the material to be melted, thereby increasing the size of the material to be melted. Since the increase of the flotation is smaller in degree than that of the weight, the levitating position of the material to be melted is gradually lowered as the material grows, and the material to be melted finally makes contact with the bottom of the crucible to be locally cooled and solidified. The solidified portion further grows as the material to be melted grows, and only the top portion of the material to be melted is melted to form the melting zone.

c) The induction coil is relatively moved as the material to be melted further grows to increase the height in accordance with the charging of chips, so that the induction coil is maintained at an adequate position with respect to the position of the melting zone of the top portion of the material to be melted. This allows the material to be melted to stably grow irrespective of the movement of the melting zone.

d) When the melting zone reaches the upper limit in the upper crucible, the relative position of the upper crucible and the induction coil is fixed, and the lower crucible is downward moved so as to maintain the positional relationship between these components and the melting zone. In the same manner as the above paragraph, this allows the material to be melted to stably grow.

e) When the lower crucible is moved by a predetermined distance, the movement of the lower crucible and the energization of the induction coil are stopped. Then, the material to be melted is not heated and is subjected only to the cooling, and hence also the melting zone is solidified to obtain a cylindrical product.

f) The material to be melted is removed as a product from the crucible, and the operation of the apparatus is stopped.

The above and further objects, features and advantages of the invention will appear more fully from the accompanying drawings and the following detailed description.

DETAILED DESCRIPTION OF THE PREFERRED EMBODIMENTS

Figure 1A:
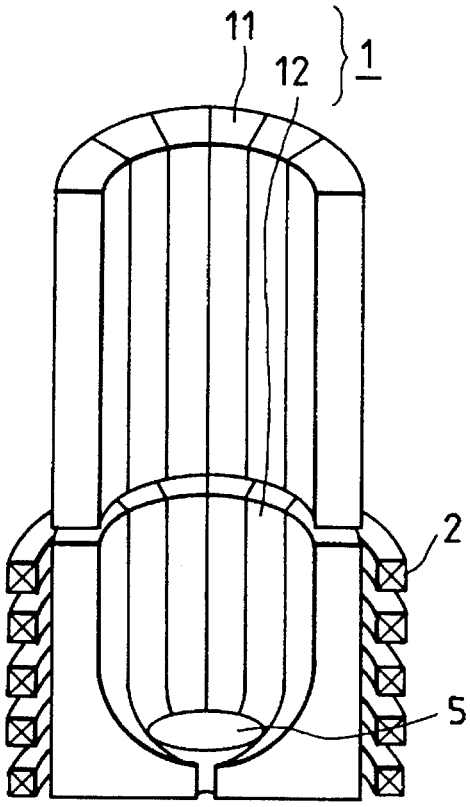
FIGS. 1(*a*) to 1(*d*) are schematic perspective sectional views showing four operation states of a levitating and melting apparatus which is a first embodiment of the invention, in which FIG. 1(*a*) shows an initial operation state, FIGS. 1(*b*) and 1(*c*) show states in the course of the operation, and FIG. 1(*d*) shows a final operation state.
Figure 1B:
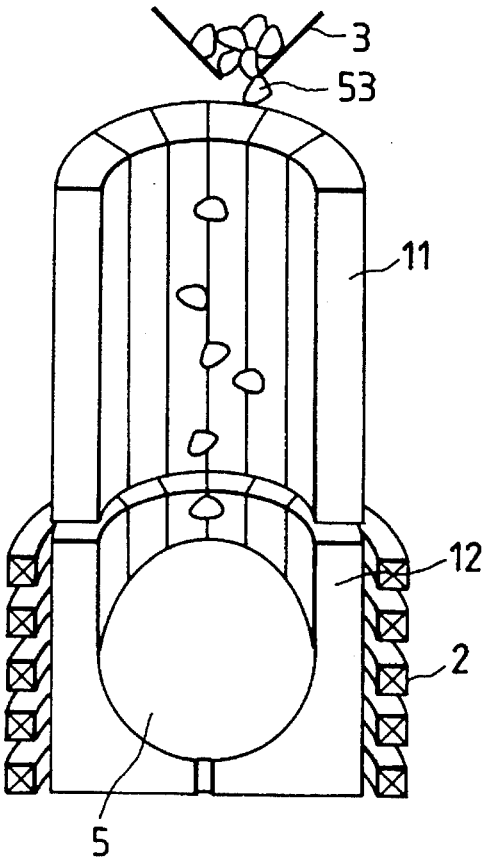
Figure 1C:
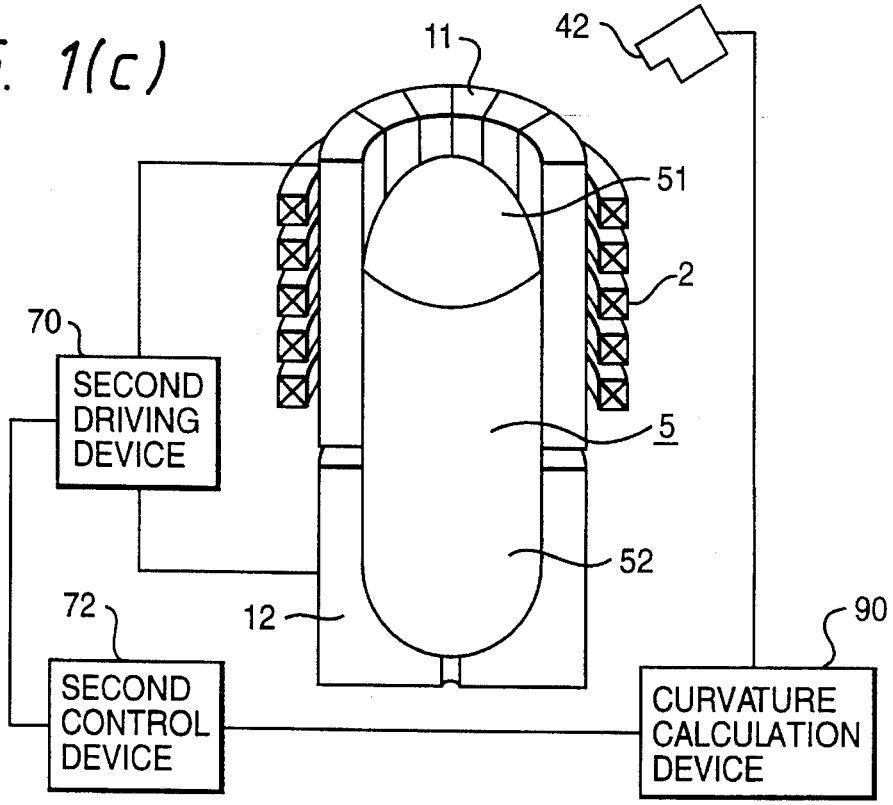
Figure 1D:
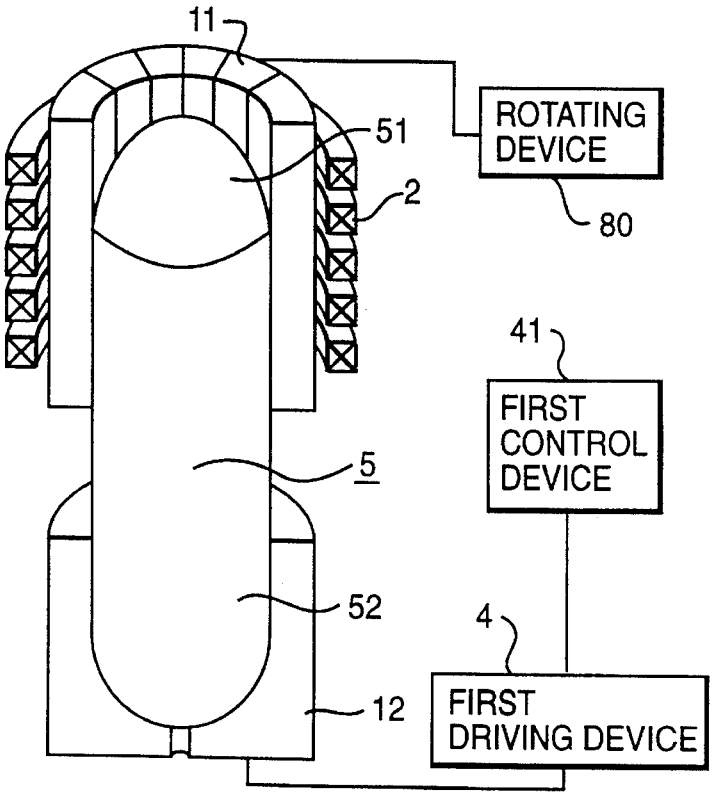

Hereinafter, embodiments of the invention will be described with reference to the accompanying drawings.

FIGS. 1(*a*) to 1(*d*) are schematic perspective sectional views showing four operation states of a levitating and melting apparatus according to an embodiment of the invention. FIG. 1(*a*) shows an initial operation state wherein a small amount of the material to be melted 5 melts while floating on a molten metal. FIG. 1(*b*) shows a state wherein the chips 53 are charged from the top by the continuous charging device 3, the material to be melted 5 sufficiently grows to make contact with the bottom of the lower crucible 12, and the solidified portion starts to be formed. In this state, the material to be melted 5 still remains in the lower crucible 12 and the solidified portion is as small as that it cannot be shown in the figure. When the operation state is transferred from that of FIG. 1(*a*) to that of FIG. 1(*b*), the upper and lower crucibles 11 and 12 are close to each other and the relative position of these crucibles is fixed. Also the induction coil 2 is approximately located at the illustrated position. Since the mean position of the material to be melted 5 which is almost in a molten state is moved upward, however, also the induction coil 2 may be moved in accordance with the movement of the mean position. In order to apply the induction heating and the floating electromagnetic force to the material to be melted 5, it is sufficient for the induction coil 2 to be disposed only in the outer face side of the lower crucible 12. Consequently, the height of the induction coil 2 is set so as to be approximately equal to that of the lower crucible 12.

FIG. 1(*c*) shows a state wherein the material to be melted 5 further grows and the melting zone 51 is in the upper crucible 11. As a result of the upward movement of the melting zone 51, the relative position of the induction coil 2 and the melting zone has been moved. In fact, it is difficult to freely move in a vertical direction the induction coil 2 and its lead wires through which a very large current of several thousands amperes flows, and hence the upper and lower crucibles 11 and 12 have been moved together downward by a second driving device 70 controlled by a second control device 72. It is a matter of course that the continuous charging device 3 which is not shown in the figure has been moved together. Under the melting zone 51, the solidified portion 52 has grown to a large size.

FIG. 1(*d*) shows a state wherein the melting zone 51 has reached the upper limit and thereafter only the lower crucible 12 is moved downward in accordance with the growth of the material to be melted 5 by a first driving device 4 controlled by a first control device 41. When the lower crucible 12 is moved downward by a predetermined distance, the melting process is substantially completed. In order that the induction coil 2 is prevented from projecting from the lower end portion of the upper crucible 11 even after the lower crucible 12 is separated from the upper crucible 11, the upper crucible 11 has a height of a sufficiently large value. The upper portion of the upper crucible 11 is not relevant to the melting process, but is used as a structure for moving or rotating the upper crucible 11 as described later. Therefore, the dimensions of the upper crucible are not restricted to those shown in the figures.

Figure 8:
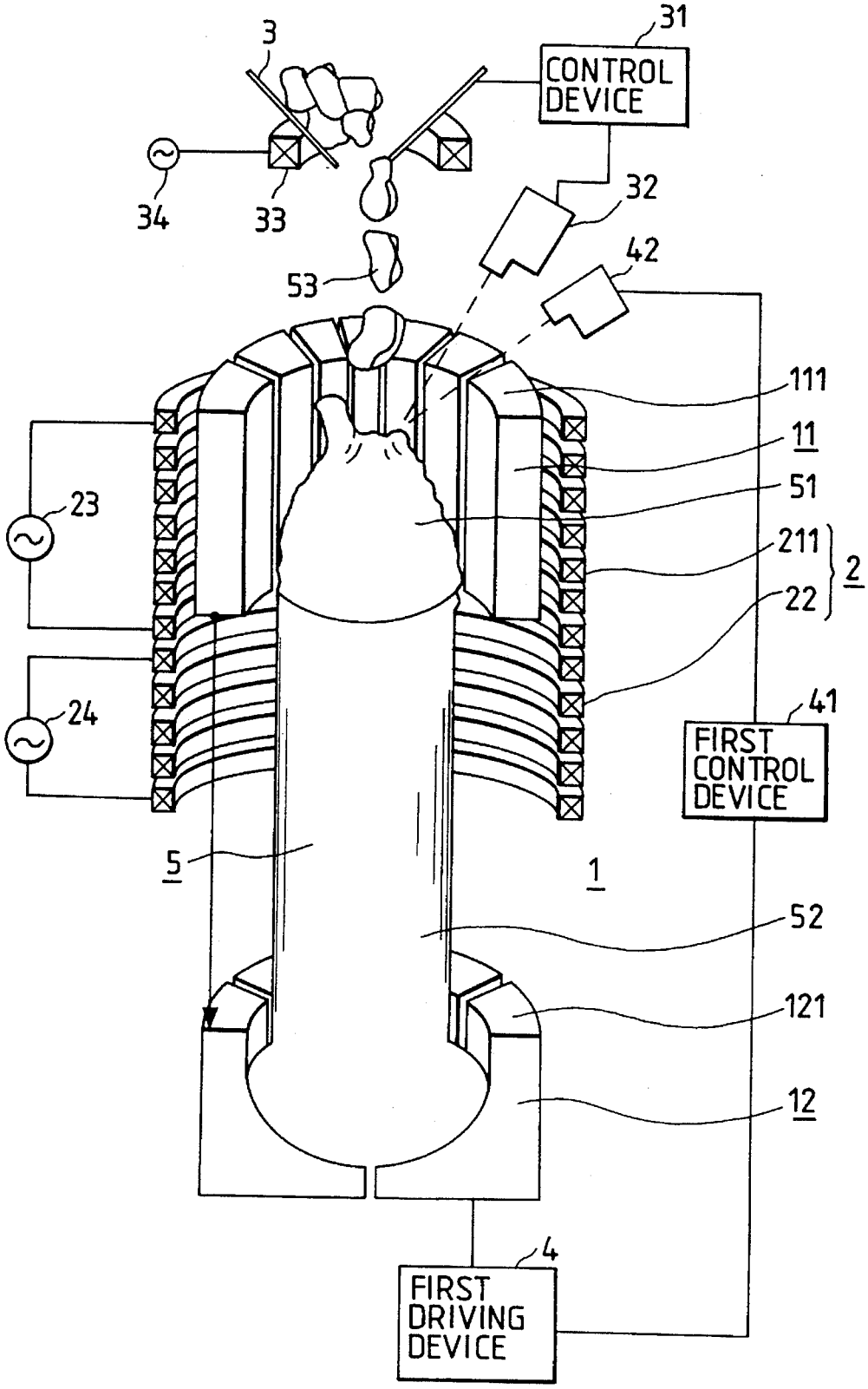
FIG. 8 PRIOR ART
FIG. 8 is a perspective longitudinal sectional view showing the whole of a levitating and melting apparatus which is in an operation state.
Figure 9:
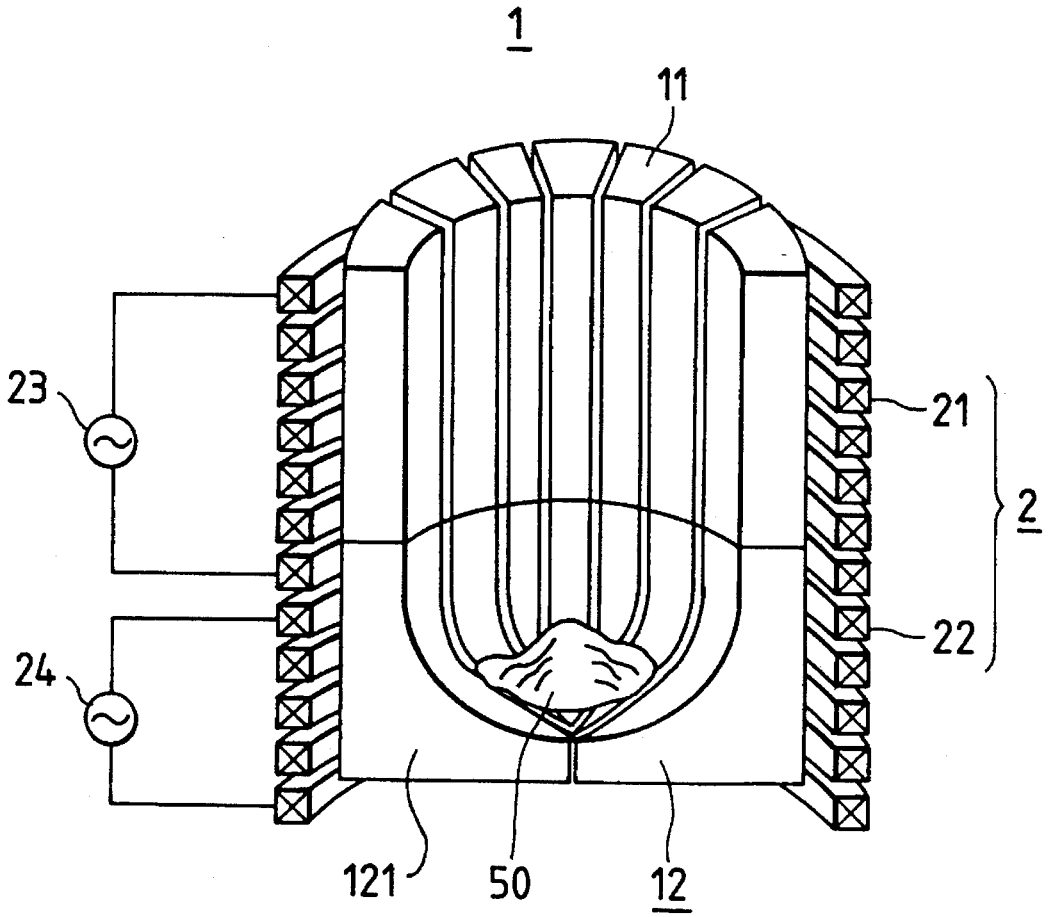
FIG. 9 PRIOR ART
FIG. 9 is a perspective longitudinal sectional view showing main portions of FIG. 8 in an initial state.

As seen from the above description, the embodiment is largely different from the levitating and melting apparatus of FIGS. 8 and 9 in that not only the lower crucible 12 but also the upper crucible 11 are movable with respect to the induction coil 2. The dimensions of the induction coil 2, or the current and number of turns of the induction coil 2 largely depend on the inner diameter of the crucible 1, and have a little dependence on the height of the crucible 1. Consequently, the inner diameter of the crucible 1 and the dimensions and values of the induction coil 2 are first decided, and, on the basis of these decided values, the heights of the lower and upper crucibles 12 and 11 are thereafter decided. At this time, the height of the upper crucible 11 can easily be set to have a large value as compared with that of the induction coil 2 as described above, so that the induction coil 2 is prevented from projecting from the upper crucible 11 under a state where the lower crucible 12 is separated from the upper crucible 11 as shown in FIG. 1(*d*), and the height of the lower crucible 12 can be easily set so that the top portion of the lower crucible 12 is located at a position sufficiently higher than the levitating position of the material to be melted 5 in the state of FIG. 1(*a*).

In a transferring process from the state of FIG. 1(*b*) to that of FIG. 1(*c*), the melting zone 51 passes the vicinity of the plane in which the upper and lower crucibles 11 and 12 are close to each other, and therefore becomes unstable. At this time, however, the melting zone 51 is not levitating and the solidified portion 52 has been grown to become mechanically stable. Consequently, the unstable melting zone 51 does not exert a great influence.

In the above, the embodiment of the levitating and melting apparatus in which not only the lower crucible but also the upper crucible are movable with respect to the induction coil has been described. In the apparatus of the embodiment, the phenomenon that the portion of the induction coil 2 projecting from the upper crucible is exposed to radiation heat from the melting zone and the solidified portion of the material to be melted as in the case of the levitating and melting apparatus shown in FIG. 8 is prevented from occurring. That is, before the melting zone grows to reach a position in the upper crucible corresponding to the top of the induction coil, the upper and lower crucibles are moved together downward with respect to the induction coil, and, after the melting zone reaches the position in the upper crucible corresponding to the top of the induction coil, the positions of the upper crucible and the induction coil are fixed and only the lower crucible is moved downward.

Next, an experimental example in which the height of the upper crucible 11 was set to be greater than that of the induction coil 2 will be described specifically. The upper crucible 11 was set to have an outer diameter of 100 mm and an inner diameter of 60 mm, and the induction coil 2 to have an inner diameter of about 106 mm and a conductor section of 10 mm square. Experiments on the levitating and melting were conducted while the size of the lower portion of the upper crucible 11 which portion downward projects from the lower end face of the induction coil 2 under the state of FIG. 1(*d*) was changed in the range of 1.5 times of the sectional dimension of the coil conductor or 15 mm to 35 mm. It was confirmed that at least in the range of 15 mm to 35 mm there is no difference in melting period, and also that the insulating material of the induction coil 2 is free from the deterioration due to radiation heat from the melting zone and solidified portion of the material to be melted.

Figure 2:
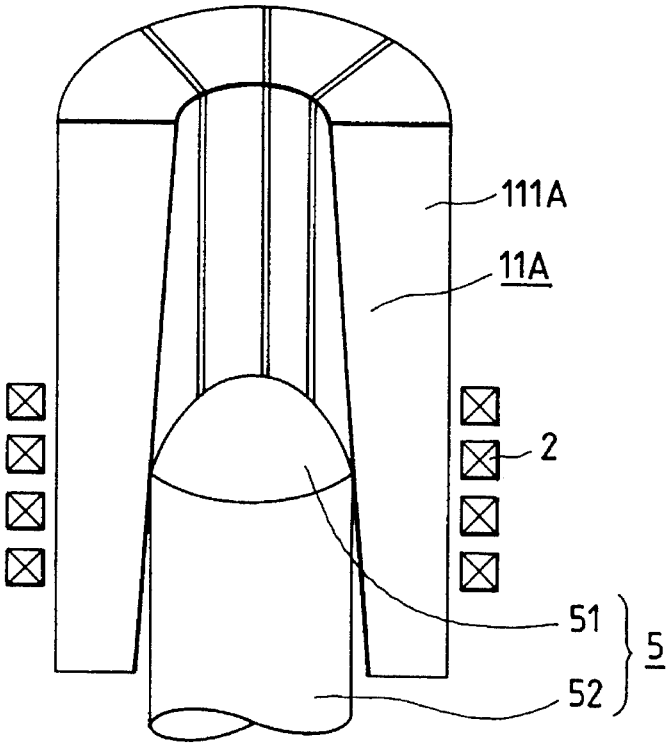
FIG. 2 is a perspective sectional view showing main portions of a levitating and melting apparatus according to a second embodiment of the invention.

FIG. 2 is a perspective sectional view showing main portions of a levitating and melting apparatus which is another embodiment of the invention. In the figure, an upper crucible 11A has an inner face of a conical shape which expands downward at a predetermined angle. Segments 111A are formed so as to comply with the conical shape. As described above, the solidified portion 52 is produced and grown by partly cooling the melting zone by means of making the melting zone contact with the inner face of the lower crucible 12 (which is not shown in the figure) in an initial stage, and with that of the upper crucible 11A from a middle of the process. When the inner diameter of the upper crucible 11A is set so as to be increased as moving downward as shown in the figure, the diameter of the solidified portion 52 at the position where the lower end of the melting zone 51 is solidified coincides with the diameter of the upper crucible 11A at this position. In the case of using a material in which variations in dimensions in melting and solidified states are large, the above-mentioned coincidence is not correct in the strict sense. This will be discussed later. In the period of the state shown in FIG. 2, the melting zone 51 is relatively raised, or the melting zone 51 thereafter remains at a fixed position and the lower crucible 12 is downward moved. During when the melting zone 51 is raised in the upper crucible 11A and the relative position of the solidified portion 52 and the upper crucible 11A is fixed, the solidified portion 52 makes contact with the inner face of the upper crucible 11A. Since, during when the melting zone 51 remains at a fixed position, the diameter of a newly produced portion of the solidified portion 52 is equal to the inner diameter of the upper crucible 11A, and hence a gap is formed between the upper crucible 11A and a portion of the solidified portion which is pulled down in accordance the growth of the solidified portion. Consequently, the contacting portion between the upper crucible 11A and the solidified portion 52 is constituted only by the tip portion where the solidification starts to be conducted, so that, during the growing process of the solidified portion 52, the friction resistance between the upper crucible 11A and the solidified portion 52 which is downward elongating is reduced to a very small level. This enables the material to be melted 5 to be smoothly moved with respect to the upper crucible 11A.

As seen from the above description, it is sufficient for the purpose that even a small gap is formed between the solidified portion 52 which has been formed and the inner face of the upper crucible 11A. Generally, therefore, the conical shape of the inner face of the upper crucible 11A may have a small angle. In the case where a material such as silicon which expands when transferring from a melting state to a solidified state is used as the material to be melted, however, the angle of inclination must be set to be a larger value in consideration of the expansion coefficient.

In a third embodiment of the invention, a method is employed in which a rotating device 80, shown in FIG. 1(*d*), rotates the upper crucible 11. The upper crucible 11 is rotated in order to reduce the friction resistance between the upper crucible 11 and the material to be melted 5.

The lower portion of material to be melted 5 makes contact with the lower crucible 12, and hence the material to be melted 5 cannot be rotated. When the upper crucible 11 is rotated, the friction resistance between the upper crucible 11 and the material to be melted 5 appears in the forms of a kinetic friction, resulting in that the friction resistance is reduced. This is because, as is well known, a kinetic friction is smaller than a static friction.

Figure 3:
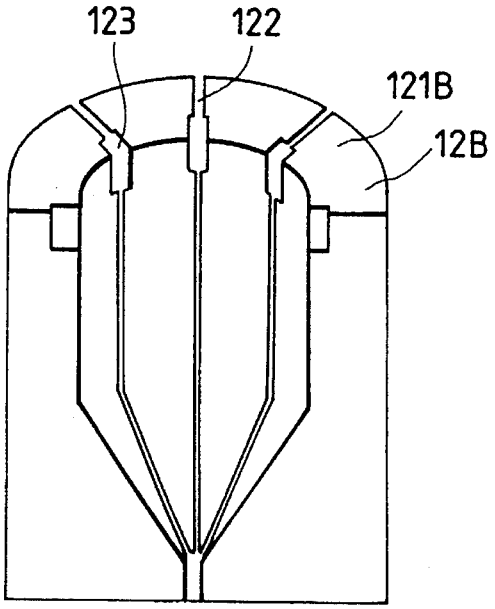
FIG. 3 is perspective sectional view showing a lower crucible according to a fourth embodiment of the invention.

FIG. 3 is perspective sectional view of a lower crucible which shows a fourth embodiment of the invention. The lower crucible 12B is different from the lower crucible 12 shown in FIGS. 8 and 9 in that the inner face of the upper end portion of each segment 121B is partly removed away to form a notched portion 123. The notched portions 123 are formed at each of connecting portions 122 in such a manner that notched portions of adjacent segments 121B oppose to each other. As described above, an insulating material such as mica is inserted into the connecting portions 122. In each of the connecting portions 122, also the insulating material is partly removed away. When the melting zone 51 is raised to pass over the notched portions and the solidified portion 52 exceeds in height the notched portions, the solidified portion 52 enters the notched portions 123 so that the resistance to the rotation is increased to a large value. Even when cracks are formed between the respective segments of the upper crucible 11 and the molten material is inserted into the cracks, therefore, the material to be melted 5 is prevented from following the rotation of the upper crucible 11, and hence the material which is once inserted into the cracks is broken. Although the friction resistance may be increased instantaneously in this case, the resistance is not thereafter accumulated so that the normal operation is maintained.

FIG. 3 shows the configuration in which the notched portions 123 are formed at each of the connecting portions 122. The number of the notched portions 123 may be reduced, and in an extreme case the number may be restricted to one. The positions of the notched portions are not restricted to those in which notched portions of adjacent segments 121B oppose to each other. In a configuration wherein notched portions are formed at vertically center portions of the segments 121B, however, it is difficult to pull out the material to be melted 5 as a product. Consequently, notched portions must be formed in the upper end portion.

Figure 4A:
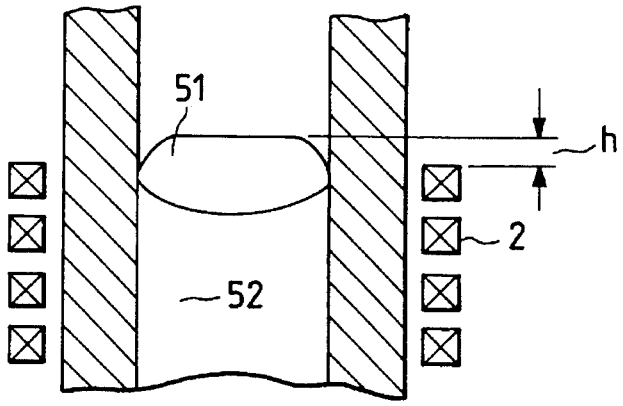
FIGS. 4(*a*) to 4(*c*) are schematic sectional views illustrating a fifth embodiment of the invention and showing relationships between a distance h between the top of a melting zone and the upper end face of an induction coil, and the shape of the melting zone, in which FIG. 4(*a*) shows a case of $h>0$, FIG. 4(*b*) shows a case of $h=0$, and FIG. 4(*c*) shows a case of $h<0$.
Figure 4B:
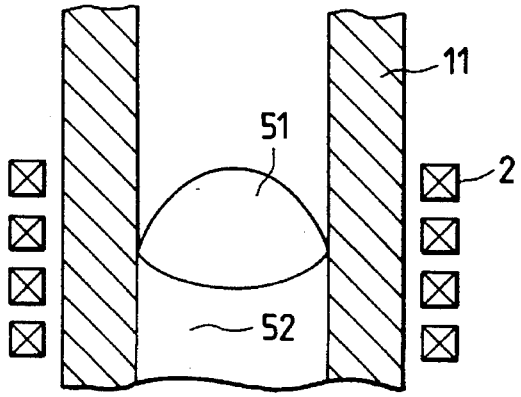
Figure 4C:
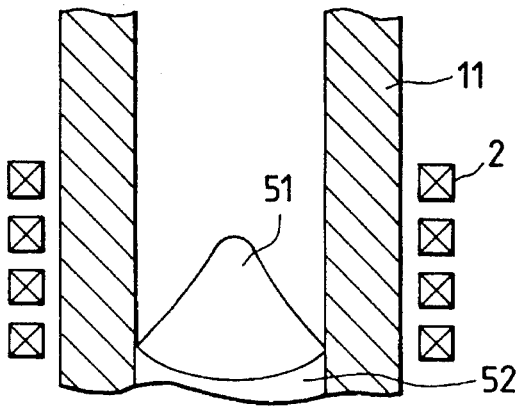

FIGS. 4(*a*) to 4(*c*) are schematic sectional views illustrating a fifth embodiment of the invention and showing relationships between a distance h between the top of a melting zone and the upper end face of an induction coil, and the shape of the melting zone.

FIG. 4(*a*) shows a case where the top of the melting zone 51 is higher than the upper end face of the induction coil 2 ($h>0$, where h is the positional difference between the top of the melting zone 51 and the upper end face of the induction coil 2), FIG. 4(*b*) a case where the top of the melting zone 51 is coincident in height with the upper end face of the induction coil 2 ($h=0$), and FIG. 4(*c*) a case where the top of the melting zone 51 is lower than the upper end face of the induction coil 2 ($h<0$).

As seen from the figures, the top of the melting zone 51 is flat in the case of FIG. 4(*a*), round in the case of FIG. 4(*b*), and pointed in the case of FIG. 4(*c*).

The reason of the above phenomena can be described roughly as follows: In the case of FIG. 4(*a*), since the induction coil 2 is located at a lower position, the strength of the magnetic field in the vicinity of the melting zone 51 is so low that the repulsive force of the melting zone 51 against the induction coil 2 is reduced, whereby the rising is reduced. In the case of FIG. 4(*c*), the strength of the magnetic field is so high that an excessive repulsive force is exerted, whereby the rising is made too high, resulting in that a pointed shape is formed. FIG. 4(*b*) shows a state in which a rising of a medium degree or an adequate degree is obtained. It was experimentally confirmed that the maximum efficiency of the induction heating on the melting zone 51 is attained in the state of FIG. 4(*b*).

Figure 5:
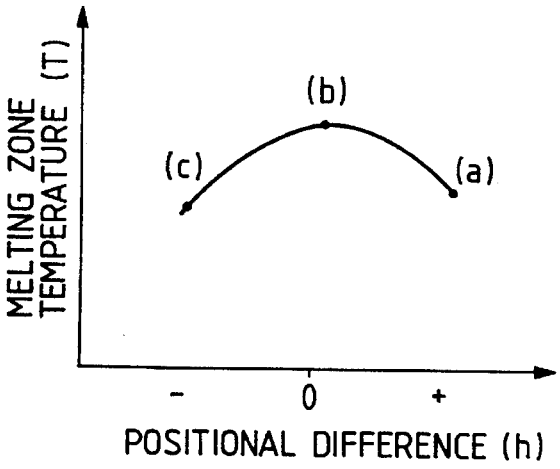
FIG. 5 is a graph schematically showing relationships between the distance h of FIGS. 4(*a*) to 4(*c*) and the temperature T of the melting zone.

FIG. 5 is a graph schematically showing relationships between the distance h of FIGS. 4(*a*) to 4(*c*) and the to be melted 5 still remains in the lower crucible 12 and the solidified portion is as small as that it cannot be shown in the figure. FIG. 7(*c*) shows a state wherein the material to be melted 5 further grows and the melting zone 51 is in the upper crucible 11. FIG. 7(*d*) shows a state wherein the melting zone 51 has reached the upper limit and thereafter only the lower crucible 12 is moved downward in accordance with the growth of the material to be melted 5. When the lower crucible 12 is moved downward by a predetermined distance, the melting process is substantially completed.

Since the inert gas 7 supplied through the gas pipe 63 of the upper gas inlet device 6 permeates the crucible 1 to sweep away the air, the material to be melted 5 of a high temperature is prevented from making direct contact with the air to be oxidized. In these steps, consequently, the inert gas 7 is supplied mainly from the upper gas inlet device 6.

In the steps of FIGS. 7(*a*) to 7(*c*), the upper and lower crucibles 11 and 12 are close to each other, and hence the supply of the inert gas 7 from the horizontal gas inlet device 60 does not exert a large effect. In a transferring step from the state of FIG. 7(*c*) to that of FIG. 7(*d*), the upper and lower crucibles 11 and 12 start to be separated from each other in accordance with the growth of the material to be melted 5, so that the material to be melted 5 is exposed in this area. As seen from the figures, the exposed portion exists in the solidified portion 52, and its temperature is sufficiently high although it is lowered as compared with the temperature of the melting zone 51. The supply of the inert gas 7 from the horizontal gas inlet device 60 exerts the effect of preventing the exposed surface from being in contact with the air to form an oxide film.

As the inert gas 7, argon gas or the like is suitable. In the case where the material to be melted 5 is a material which does not react with nitrogen, it is sometimes more adequate to use nitrogen gas that is inexpensive.

In place of the system in which a levitating and melting apparatus is placed in a vacuum vessel, as described above, the configuration and operating method in which the gas inlet devices 6 and 60 are disposed and the material to be melted 5 is covered by an inert gas so as not to make direct contact with the air are employed. This enables a levitating and melting apparatus to be constructed in a simplified structure and hence by a reduced cost, and also to produce a product of a high quality.

According to the invention, as described above, in addition to the first driving device which moves only the lower crucible, and the first control device which controls the first driving device, the second driving device which changes the vertical relative position of the upper crucible and the induction coil, and the second control device which controls the second driving device are additionally disposed. This enables the relative positions of the induction coil and the upper and lower crucibles to adequately be set in accordance with the position of the melting zone in the top portion of the material to be melted, in the initial operation stage in which the material to be melted 5 is melting while levitating, the final operation stage in which the solidified portion has grown and the lower crucible is largely separated from the upper crucible, and the intermediate period which is between the initial and final stages. Therefore, the heights of the upper and lower crucibles are not restricted by the height of the induction coil, and can be set to be a large value. As a result, the material to be melted which is in the levitating and melting state is not adversely affected in the initial operation stage by magnetic fluxes leaking from a gap between the upper and lower crucibles. Moreover, the induction coil does not downward project from the upper crucible, so that a solidified portion of the material to be melted is prevented from being again melted, and the deterioration of the insulating material of the induction coil is not accelerated by radiation heat from the melting zone and the solidified portion. Consequently, the invention can accomplish an effect that a levitating and melting apparatus which can stably be operated and has high reliability is obtained.

When the inner face of the upper crucible is formed into a conical shape which expands downward at a predetermined angle, the lower end portion of the surface area of the melting zone which makes contact with the inner face of the upper crucible and is then solidified has a diameter that is smaller than the inner diameter of a portion of the upper crucible which is lower than the solidified portion. Accordingly, a gap is formed between the solidified portion and the upper crucible so that the friction resistance generated when the solidified portion is lowered together with the lower crucible is reduced to a very small level. Consequently, a long cylindrical solidified portion can be produced smoothly by moving the lower crucible.

In the configuration wherein an upper-crucible rotating device which rotates the upper crucible is disposed and the upper crucible is rotated, since the solidified portion of the material to be melted is fixed to the lower crucible, the inner face of the upper crucible, and the outer face of the solidified portion making contact with the inner face are moved while rubbing against each other, resulting in that the friction resistance between the upper crucible and the solidified portion appears in the form of a kinetic friction. Since a kinetic friction is smaller in resistance than a static friction, the downward movement of the material to be melted in accordance with the growth of the material to be melted is conducted more smoothly, thereby producing an effect that a stale operation can be conducted.

In the above-mentioned configuration wherein the rotating device for the upper crucible is provided, at least one notched portion may be formed on the inner face of an upper portion of the lower crucible. The material to be melted enters the notched portion and is then solidified therein so that the resistance to the rotation is increased to a very large value. Even when cracks are formed between the respective segments of the upper crucible and the molten material is inserted into the cracks and the friction resistance to the torque between the upper crucible and the material to be melted is increased, therefore, the material to be melted is prevented from rotating with respect to the lower crucible or sliding over it, so that the state between the upper crucible and the material to be melted is stably maintained in the kinetic friction state, thereby producing an effect that the stability of the operation is improved.

When gas inlet devices such as described above are disposed and an inert gas is supplied into the crucible in a melting process so that the material to be melted is prevented from making direct contact with the air, the apparatus can be configured more simply than the system in which a levitating and melting apparatus is placed in a vacuum vessel, with the result that the apparatus can be constructed by a reduced cost and produce a product of a higher quality.

In an embodiment, the curvature of the vicinity of the top of the melting zone is obtained, and the relative position of the induction coil and the crucible is controlled so that the value is coincident with a predetermined value. The maximum efficiency is attained when the curvature of the top of the melting zone is close to the radius of the inner diameter temperature of the melting zone. In the figure, the abscissa indicates the positional difference h, which is shown in FIGS. 4(*a*) to 4(*c*), between the top of the melting zone 51 and the upper end face of the induction coil 2, and the ordinate indicates the temperature T of the melting zone 51 which is measured by the molten metal thermometer of FIG. 8.

The relationship between the distance h and the temperature T of the melting zone in the state of FIG. 4(*a*) is indicated by point (*a*). Similarly, the relationship in the state of FIG. 4(*b*) is indicated by point (*b*), and that in the state of FIG. 4(*c*) by point (*c*). A situation that the temperature T is high means that the melting zone is supplied with a larger power, or the efficiency is excellent. Consequently, it will be seen that the maximum efficiency is attained in the state of h=0 or that of FIG. 4(*b*). When the control is appropriately conducted to maintain the state of FIG. 4(*b*), therefore, the maximum efficiency can be maintained.

The state of FIG. 4(*b*) is characterized in that h is equal to 0 (h=0) and the melting zone 51 has a round shape. Results of measurements under various conditions revealed that the maximum efficiency is attained not in the state of h=0 but in the state where the melting zone 51 has a round shape. In other words, since the influence of the induction coil 2 on the melting zone 51 is affected not only by the relative position but also by the frequency and the ampere turn, the maximum efficiency is not always attained when h is equal to 0.

The structure in which the melting zone 51 has a round shape means that the curvature of the top portion is substantially equal to a half of the inner diameter of the upper crucible 11. As seen from FIG. 5, even when the conditions are slightly shifted from those for attaining the maximum efficiency, the resulting efficiency (in the figure, the temperature) is not largely changed, and hence it is not required to strictly set the curvature to be the value for attaining the maximum efficiency.

In any event, the maximum efficiency can be attained by conducting the control so as to round the top portion of the melting zone 51.

Specifically, the control is conducted in such a manner that the molten metal level gauge 42 shown in FIGS. 1(*c*) and 8 measures the levels of plural points of the vicinity of the top portion of the melting zone 51, curvature calculation means or device 90 shown in FIG. 1(*c*) calculates the curvature of the top portion on the basis of the measuring results, and a feedback control is done so as to make the calculated curvature coincident with a predetermined value. An optical range finder using a laser is suitable for the molten metal level gauge 42. It is appropriate that the control object is the relative position of the crucible 1 and the induction coil 2. The curvature calculation means 90 may be an analog arithmetic unit, or a digital arithmetic unit using a computer. Alternatively, the curvature calculating means 90 may easily be realized by incorporating it into the above-described first or second control devices 42, 70. The control of the relative position of the induction coil 2 and the crucible 1 in FIG. 1 is conducted by the first and second control devices 42, 70. These control devices 42, 70 are separated from each other only in a functional meaning, and actually configured as one control device. In order to more precisely control the position of the induction coil 2, the control device may conduct a feedback control in which both the position and curvature of the top of the melting zone 51 are considered. Such a control device can be realized in various forms within the range of the prior art.

In the above, the embodiment of the levitating and melting apparatus in which the position of the melting zone is controlled to maximize the efficiency of the induction heating on the melting zone has been described. In a summary, in the apparatus of the embodiment, it is essential to relatively move the crucible, in order to keep the position of the top of the melting zone existing at the level of the upper end of the induction coil or to make the curvature of the top portion of the melting zone substantially equal to a half of the inner diameter of the upper crucible. To comply with this, the position of the melting zone with respect to the induction coil is controlled in the manner described above.

Figure 6:
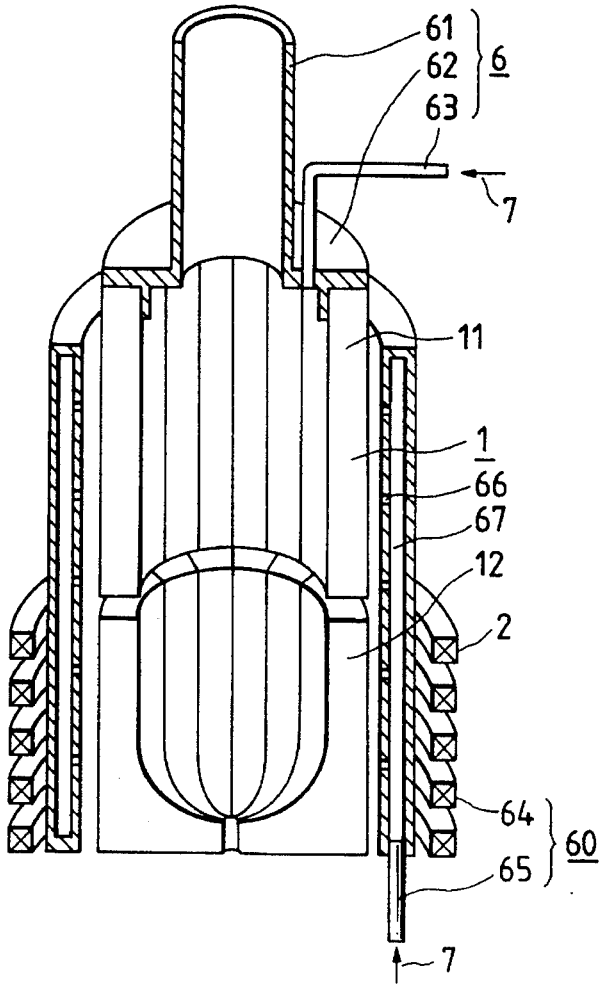
FIG. 6 is a schematic perspective section view of a levitating and melting apparatus according to a sixth embodiment of the invention.
Figure 7A:
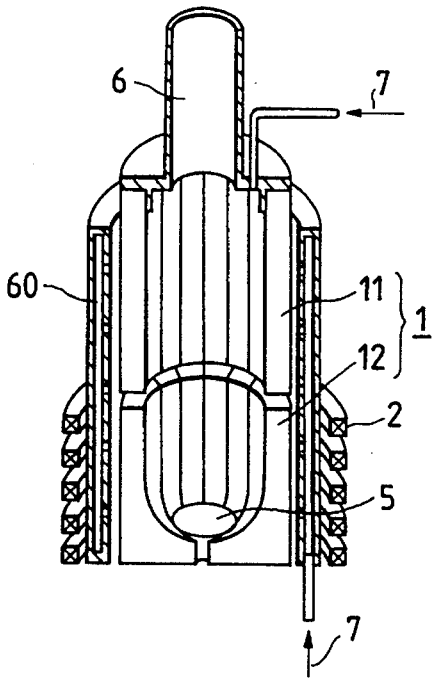
FIGS. 7(*a*) to 7(*d*) are schematic perspective sectional views showing four operation states of the levitating and melting apparatus of FIG. 6, in which FIG. 7(*a*) shows an initial operation state, FIGS. 7(*b*) and 7(*c*) show states in the course of the operation, and FIG. 7(*d*) shows a final operation state.
Figure 7B:
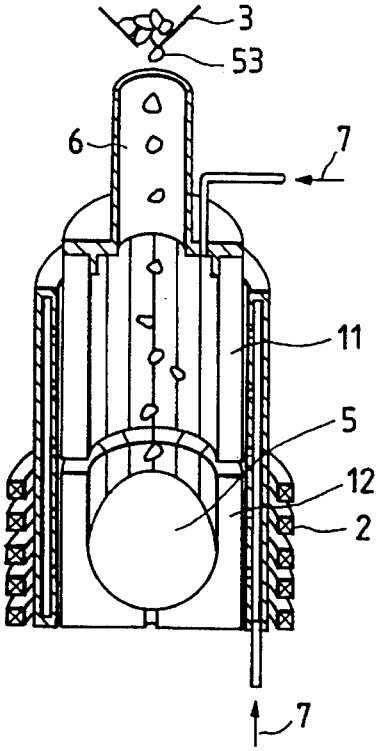
Figure 7C:
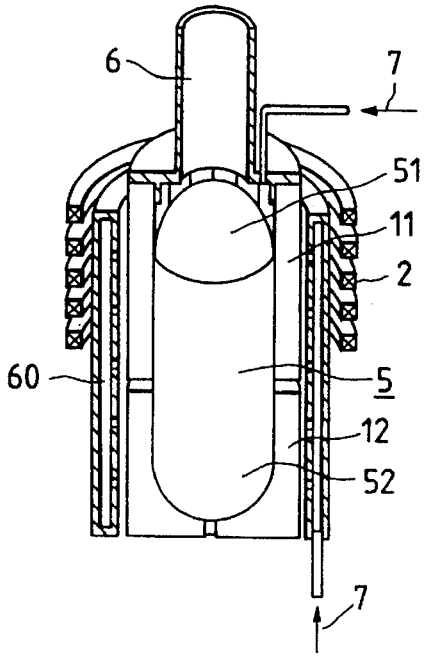
Figure 7D:
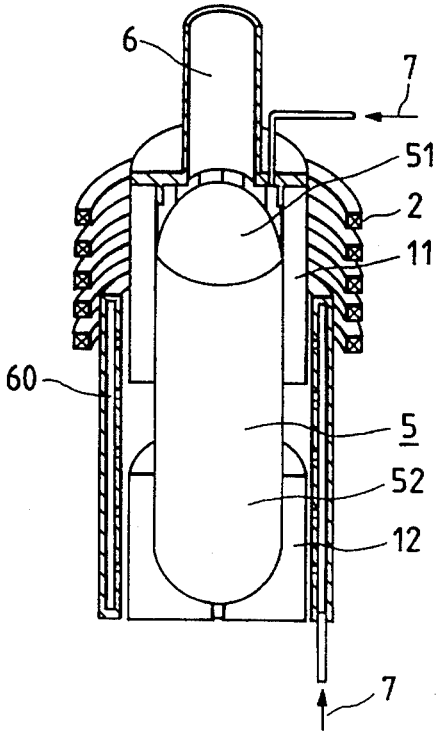

FIG. 6 is a schematic perspective sectional view of a levitating and melting apparatus which is a sixth embodiment of the invention. The levitating and melting apparatus shown in the figure is different from that shown in FIG. 1 in that gas inlet devices are disposed. Namely, an upper gas inlet device 6 is disposed above the crucible 1, and a horizontal gas inlet device 60 is disposed between the crucible 1 and the induction coil 2 in a concentrical manner. The upper gas inlet device 6 comprises a lid 62 for covering the upper portion of the upper crucible 11, a cylinder portion 61 functioning as a charging port for charging chips 53, and a gas pipe 63 which is connected to the lid 62 and through which an inert gas 7 is introduced from the outside into the crucible 1. The horizontal gas inlet device 60 comprises a hollow cylinder portion 64 which is hollow and has a gas outlet hole 66 opened on the inner wall, and a gas pipe 65 through which the inert gas 7 is introduced into the hollow portion 67 of the hollow cylinder portion 64. The inert gas 7 introduced into the hollow portion 67 through the gas pipe 65 flows out from the gas outlet hole 66 toward the crucible 1. As described later, the inert gas 7 shields the material to be melted 5 the surface of which is exposed in the area where the upper and lower crucibles 11 and 12 are separated from each other, from the air.

The inert gas 7 flowing into the crucible 1 through the gas pipe 63 leaks from gaps formed between the cylinder portion 61 and the upper and lower crucibles 11 and 12, and the like. Therefore, the inert gas must be supplied continuously. This is applicable also to the gas pipe 65. Since the charging of the chips 53 through the cylinder portion 61 is conducted in a somewhat intermittent manner, the leaking amount of the inert gas can be reduced by taking a countermeasure such as that the cylinder portion is closed during a non-charging period.

The gas inlet devices 6 and 60 must be made of a material which satisfies conditions that it is an insulating material so that no current due to electromagnetic induction flows, and that it has heat resistance sufficient for radiation heat from exposed portions of the melting zone 51 and solidified portion 52. Materials satisfying these conditions include inorganic insulating materials such as quarts glass, and ceramics.

FIGS. 7(*a*) to 7(*d*) are schematic perspective sectional views showing four operation states of the levitating and melting apparatus of FIG. 6, which are four subfigures respectively corresponding to the four subfigures of FIGS. 1(*a*) to 1(*d*), and the subfigures designated by the same letter in parentheses show the same step of the melting process. That is, FIG. 7(*a*) shows an initial operation state wherein a small amount of the material to be melted 5 melts while levitating on a molten metal. FIG. 7(*b*) shows a state wherein the chips 53 are charged from the top by the continuous charging device 3, the material to be melted 5 sufficiently grows to make contact with the bottom of the lower crucible 12, the solidified portion starts to be formed, but the material of the crucible. When this state is maintained by conducting the above-mentioned control, therefore, an effect is accomplished that the operation can be conducted while attaining the maximum efficiency in the period succeeding the formation of the solidified portion.

When the operation is conducted in the sequence of the aforementioned paragraphs a) to e), the above effects can be accomplished more surely.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A levitating and melting apparatus comprising:

a crucible system including upper and lower crucible portions, said portions being divided along a substantially horizontal plane, said upper crucible portion having a conical shaped inner face expanding downward at an angle, said upper and lower crucible portions having a plurality of segments comprised of conductive metal, each segment being separated from another segment by insulating material;

an induction coil disposed outside said crucible system;

an AC power source for supplying current to said induction coil;

a device for continuously charging conductive metal chips entering said upper portion of said crucible system;

first driving means for changing relative vertical positions of said upper and lower crucible portions;

first control means for controlling said first driving means;

second driving means for changing relative vertical positions of said upper crucible portion and said induction coil; and second control means for controlling said second driving means.

2. The levitating and melting apparatus according to claim 1, further comprising a rotating device for rotating said upper crucible portion at least during a period when material to be melted grows and makes contact with the inner face of said upper crucible portion.

3. The levitating and melting apparatus according to claim 2, wherein at least one notched portion is formed on an inner face of an upper segment of said lower crucible portion.

4. A levitating and melting apparatus comprising:

a crucible system including upper and lower crucible portions, said portions being divided along a substantially horizontal plane, said upper and lower crucible portions having a plurality of segments comprised of conductive metal, each segment being separated from another segment by insulating material;

an induction coil disposed outside said crucible system;

an AC power source for supplying current to said induction coil;

a device for continuously charging conductive metal chips entering said upper portion of said crucible system;

first driving means for changing relative vertical positions of said upper and lower crucible portions;

first control means for controlling said first driving means;

second driving means for changing relative vertical positions of said upper crucible portion and said induction coil;

second control means for controlling said second driving means;

an upper gas inlet device disposed on an upper section of said upper crucible portion, the upper gas inlet device including a gas pipe for flowing inert gas into said upper crucible portion; and a horizontal gas inlet device including a hollow tubular portion located between said crucible system and said induction coil, a gas outlet hole disposed on an inner face of said tubular portion, and a gas pipe for flowing inert gas into an inside of said hollow tubular portion.

5. A levitating and melting apparatus comprising:

a crucible system including upper and lower crucible portions, said portions being divided along a substantially horizontal plane, said upper and lower crucible portions having a plurality of segments comprised of conductive metal, each segment being separated from another segment by insulating material;

an induction coil disposed outside said crucible system;

an AC power source for supplying current to said induction coil;

a device for continuously charging conductive metal chips entering said upper portion of said crucible system;

first driving means for changing relative vertical positions of said upper and lower crucible portions;

first control means for controlling said first driving means;

second driving means for changing relative vertical positions of said upper crucible portion and said induction coil;

a molten level gauge for measuring vertical position of an upper face of melted conductive material;

curvature calculation means for calculating curvature of said upper face of the melted conductive material based on a signal output from said molten level gauge; and second control means for controlling said second driving means to maintain the relative vertical positions of said induction coil and said upper crucible portion according to a signal from said curvature calculation means so that said second control means controls the curvature of said upper face.

* * * * *